US005917392A

United States Patent [19]

Finfera

[11] Patent Number: 5,917,392

[45] Date of Patent: Jun. 29, 1999

[54] SWITCHING ARRANGEMENT FOR CONNECTING AND/OR SEPARATING TWO SECTIONS OF AN ELECTRICAL LINE

[75] Inventor: Wolfram Finfera, Munich, Germany

[73] Assignee: Tektronix, Inc., Wilsonville, Oreg.

[21] Appl. No.: 09/008,136

[22] Filed: Jan. 16, 1998

[51] Int. Cl.[6] ..... H01H 9/00; H01H 1/66; H01H 51/00

[52] U.S. Cl. ..... 335/205; 200/51.1; 439/38; 335/151; 335/154; 335/206

[58] Field of Search ..... 335/151–154, 335/205–207; 200/51.1, 51.11; 439/38

[56] References Cited

U.S. PATENT DOCUMENTS 3,707,627 12/1972 Sheppard ..... 246/192
3,980,980 9/1976 Zioni et al. ..... 335/205
4,073,309 2/1978 Fraser et al. ..... 137/344

*Primary Examiner*—Michael L. Gellner
*Assistant Examiner*—Raymond Barrera
*Attorney, Agent, or Firm*—Thomas F. Lenihan

[57] ABSTRACT

The invention relates to a switching arrangement for connecting and/or separating two sections (7, 8) of an electrical line (3), said arrangement comprising a switching device (10) having contact elements (11, 12) which are connected to said two line sections (7, 8) as well as a plug device (15) having an actuation element (20) and plug contacts (18, 19).

For providing a switching arrangement of particularly simple design for connecting and/or separating two sections of an electrical line, the present invention proposes that the contact elements (11, 12) be electrically connected to the actuation reeds of a reed contact (25) and the actuation element (20) be means magnetically influencing said reed contact which will open said reed contact (25) when the plug devide (15) is plugged in.

5 Claims, 1 Drawing Sheet

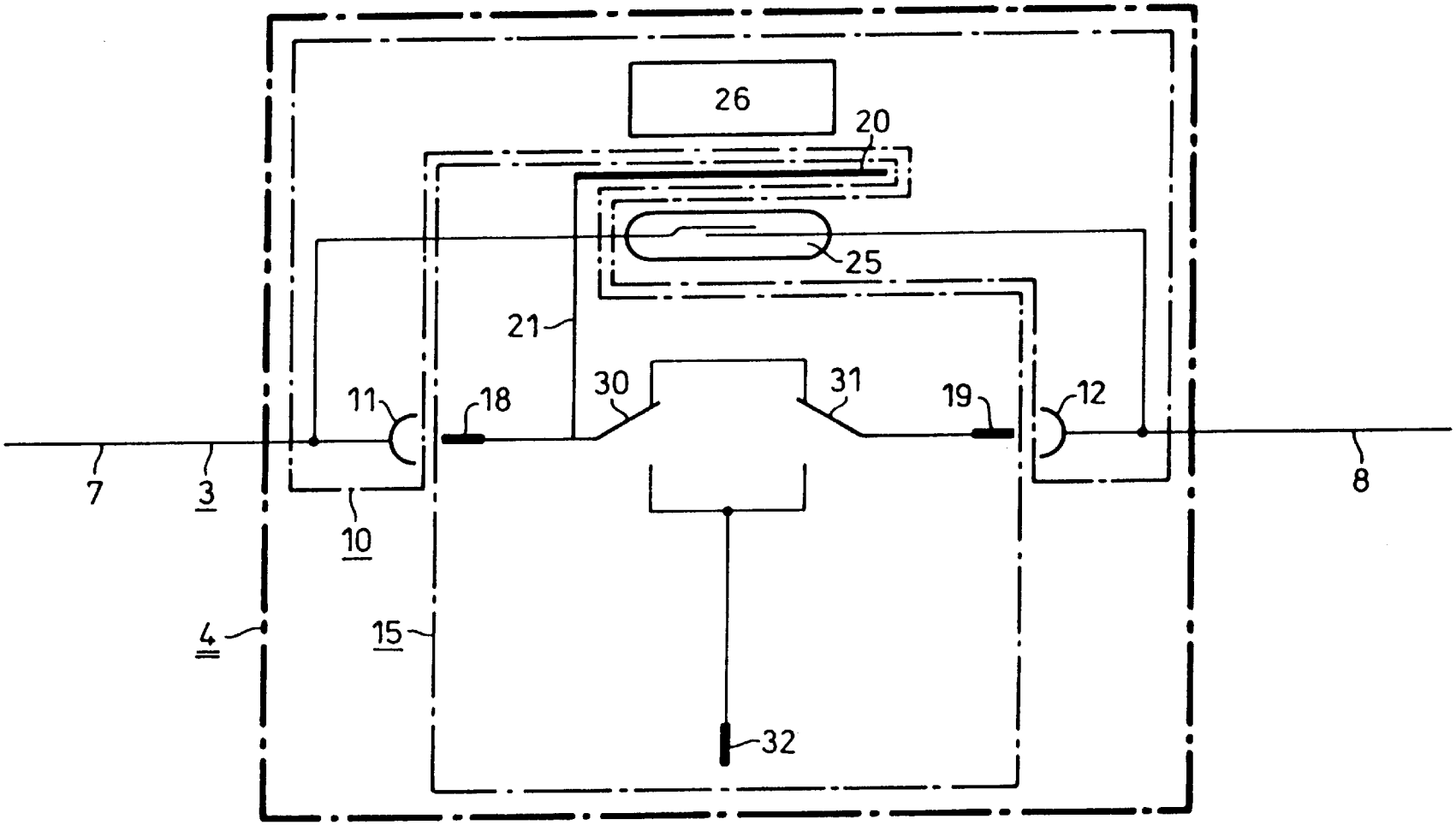
8
12
19
31
32
20
25
26
30
21
18
11
10
15
3
4
7

SWITCHING ARRANGEMENT FOR CONNECTING AND/OR SEPARATING TWO SECTIONS OF AN ELECTRICAL LINE

FIELD OF THE INVENTION

The present invention relates to a switching arrangement for connecting and/or separating two sections of an electrical line, said arrangement comprising a switching device having contact elements which are connected to said two line sections as well as a plug device having an actuation element and plug contacts.

BACKGROUND OF THE INVENTION

In a known switching arrangement of this type (German patent specification serial no. 1 802 457) the switching device is constituted by a spring-supported ball-shaped contact member and two contact elements. In this prior art switching arrangement, the plug device is provided in the form of a plug which has an actuation member as the actuation element. In this prior art switching arrangement, the actuation member is urged into contact with the spring-supported contact member when said plug is plugged in, with the result that the contact member is moved from its rest position and the electrical connection between the contact elements is interrupted. When the plug is removed, the force of the spring will cause the contact member to return to its rest position, and the electrical contact between the two contact elements will be reestablished.

SUMMARY OF THE INVENTION

It is the object of the present invention to provide a switching arrangement of a particularly simple design for connecting and/or separating two sections of an electrical line.

For a switching arrangement of the kind mentioned at the beginning hereof, it is proposed according to the present invention to accomplish this object in that the contact elements are electrically connected to the actuation reeds of a reed contact of the switching device and in that the actuation element is a means which magnetically influences said reed contact, thereby opening said reed contact when the plug device is plugged in.

The advantage of the switching arrangement according to the present invention is that by using a reed contact and means which magnetically influences said reed contact, it is possible to obtain a switching arrangement of particularly simple and thus inexpensive design.

In the switching arrangement according to the present invention, the reed contact is of a particularly simple type, thus making it particularly advantageous to magnetically influence it if a magnet arrangement is allocated to the reed contact in the form of a working contact, if the magnetically influencing means has a magnetic shielding effect and if the magnetically influencing means is located between the magnet arrangement and the reed contact when the plug device is plugged in.

A switching arrangement which is equivalent in its effect to this embodiment of the inventive switching arrangement may be obtained if the reed contact is a break contact and the magnetically influencing means is magnetic.

In order to be able to exactly specify the switching point when plugging in the plug device, the magnetic flux adjacent the reed contact must be adjustable. This can be ensured by providing auxiliary elements adjacent said reed contact which will influence the magnetic flux of the magnet arrangement.

BRIEF DESCRIPTION OF THE DRAWING

The present invention will now be shown and described with reference to a preferred embodiment thereof and with reference to the illustrative drawing, in which the (only) FIGURE is a schematical view of an embodiment of a switching arrangement for connecting and/or separating two line sections according to the present invention.

DETAILED DESCRIPTION

The FIGURE shows an electrical line 3 which is separated into two line sections 7 and 8 by a switching arrangement 4. The switching arrangement 4 comprises a switching device 10 having contact elements 11 and 12 and a plug device 15 having plug contacts 18 and 19 as well as an actuation element 20. The actuation element 20 may for example be an iron sheet; the mechanical connection between the plug contacts 18 and 19 and the actuation element 20 is indicated in the FIGURE by a line 21. The switching device 10 includes a reed contact 25 adjacent to which a magnet arrangement 26 is provided. Between said magnet arrangement 26 and said reed contact 25 is a gap into which the actuation element 20 of the plug device 15 can be introduced.

In the plug device 15 switches 30 and 31 may for example be provided via which either or both line sections 7, 8 of the electrical line 3 may selectively be connected to an output terminal 32; connected to said output terminal 32 may for example be a measuring instrument (not shown).

When the plug device 15 is plugged in, the actuation element 20 is guided between the reed contact 25 and the magnet arrangement 26. The actuation element, which may be of e.g. iron as already set out heretofore, has a magnetically shielding effect, i.e. it interrupts the magnetic flux between the magnet arrangement 26 and the reed contact 25. The reed contact 25 in this embodiment of the switching arrangement according to the invention is a reed contact which is electrically open in the absence of any influence of a magnetic field, i.e. a contact which constitutes a working contact. As a consequence, when the plug device 15 is plugged in and the magnetic field of the magnet arrangement 26 is shielded, no electrical contact is established by the reed contact 25, thus forcing the electrical current to flow from one line section 7 to the other line section 8 of the electrical line 3 via the plug device 15. When the plug device 15 and thus the actuation element 20 is removed, the reed contact 25 is exposed to the magnetic field of the magnet arrangement 26. The magnetic field of the magnet arrangement 26 pulls both contact actuation reeds of the reed contact 25 in the direction of the magnet arrangement 26, thus establishing electrical contact between the actuation reeds of the reed contact 25 and electrical contact between the contact elements 11 and 12 of the switching arrangement 4.

By providing auxiliary elements influencing the magnetic flux of the magnet arrangement 26 and forming a magnetic shunt, e.g. ferrite rods, the axes of which are orientated in parallel to the reed contact 25, or ferrite plates, the magnetic flux of the magnet arrangement 26 may be set such that it is already ensured before the complete separation of the plug device 15 from the switching device 10 that the reed contact 25 is closed electrically upon removal of the plug device 15. For the sake of clarity, such auxiliary elements influencing the magnetic flux of the magnet arrangement 26 are not shown in the FIGURE.

What is claimed is:

1. A switching arrangement for connecting and/or separating two sections (7, 8) of an electrical line (3), said arrangement comprising:

a switching device (10) having electrical switch contact elements (11, 12) said electrical switch contact elements being connected to said two line sections (7, 8); and a plug device (15) moveable between a first position and a second position with respect to said switching device, said plug device having an actuation element (20) and having electrical plug contacts (18, 19);

said electrical switch contact elements (11, 12) being electrically connected to actuation reeds of a reed contact (25) of the switching device (10);

said actuation element (20) magnetically influencing said reed contact to open said reed contact (25) when said plug device (15) is in said first position;

said electrical switch contacts and said electrical plug contacts being electrically connected when said plug device is in said first position and disconnected when said plug device is in said second position; and, said reed contact closing when said plug device is moved to said second position wherein said actuating device no longer magnetically influences said reed contact.

2. The arrangement as claimed in claim 1 wherein said reed contact (25) in the form of a working contact is allocated a magnet arrangement (26), said magnetically influencing means has a magnetically shielding effect and when the plug device (15) is plugged in, said magnetically influencing means is located between the magnet arrangement (26) and the reed contact (25).

3. The arrangement as claimed in claim 1 wherein the reed contact (25) is a break contact and the magnetically influencing means is magnetic.

4. The arrangement of claim 1 wherein said plug further includes:

a further switching device coupled between said electrical plug contacts (18,19) for selectably connecting said two line sections.

5. The arrangement of claim 4 wherein said further switching device comprises:

a series connection of switches coupled between said electrical plug contacts (18,19) for selectably connecting said two line sections; and an output terminal coupled to the junction of said series-connected switches.

* * * * *